US008720144B2

(12) United States Patent
Keane

(10) Patent No.: US 8,720,144 B2
(45) Date of Patent: May 13, 2014

(54) LUXURY VINYL TILE FLOORING SYSTEM

(76) Inventor: Craig Patrick Keane, Mullica Hill, NJ (US)

( * ) Notice: Subject to any disclaimer, the term of this patent is extended or adjusted under 35 U.S.C. 154(b) by 0 days.

(21) Appl. No.: 13/473,530

(22) Filed: May 16, 2012

(65) Prior Publication Data

US 2012/0291387 A1 Nov. 22, 2012

Related U.S. Application Data

(60) Provisional application No. 61/519,112, filed on May 16, 2011.

(51) Int. Cl.
*E04F 15/22* (2006.01)
*E04F 15/02* (2006.01)
*E04F 15/18* (2006.01)

(52) U.S. Cl.
CPC ..... *E04F 15/02* (2013.01); *E04F 15/18* (2013.01)
USPC ..... 52/403.1; 52/309.4

(58) Field of Classification Search
USPC ..... 52/177, 403.1, 408, 309.8, 409, 411, 52/309.4; 472/92
See application file for complete search history.

(56) References Cited

U.S. PATENT DOCUMENTS 4,196,243 A * 4/1980 Sachs et al. ..... 428/147
5,137,764 A * 8/1992 Doyle et al. ..... 428/44
5,578,363 A 11/1996 Finley et al.
5,627,231 A * 5/1997 Shalov et al. ..... 524/523
6,189,279 B1 * 2/2001 Fiechtl ..... 52/403.1
6,286,280 B1 * 9/2001 Fahmy et al. ..... 52/408
6,365,001 B1 * 4/2002 Helwig et al. ..... 162/135
6,524,978 B1 * 2/2003 Moore ..... 442/85
6,576,577 B1 * 6/2003 Garner ..... 442/374
6,579,610 B1 * 6/2003 Shortland et al. ..... 428/323
6,599,599 B1 * 7/2003 Buckwater et al. ..... 428/40.1
6,607,803 B2 * 8/2003 Foster ..... 428/77
6,635,727 B1 * 10/2003 Koda et al. ..... 526/160
6,673,177 B2 * 1/2004 Buckwalter et al. ..... 156/71
6,803,110 B2 * 10/2004 Drees et al. ..... 428/423.7
6,837,014 B2 * 1/2005 Virtanen ..... 52/390

(Continued)

OTHER PUBLICATIONS

Toray Plastics (America), Inc., "Welcome to Toray Plastics TORAYPEF-Polypropylene Foams", http://www.torayfoam.com/products/polypropylene.html, © 2005, accessed Jul. 27, 2006, 1 page.

(Continued)

*Primary Examiner* — William Gilbert
*Assistant Examiner* — James Ference
(74) *Attorney, Agent, or Firm* — Condo Roccia Koptiw LLP

(57) ABSTRACT

A flooring system may comprise a top floor layer, a subfloor, and/or an underlayment material disposed between the subfloor and the top floor layer. The top floor layer may include a plurality of luxury vinyl tiles, configured such that respective tile joints may be formed between adjacent luxury vinyl tiles. The underlayment material may comprise a cross-linked, polyolefin foam. The composition of the underlayment material may be such that the tile joints between the adjacent luxury vinyl tiles may bend by less than about 45 degrees over a twelve hour period when 3.1 pounds per square inch (psi) of pressure is applied. The underlayment material may have a compressive creep of less than fifty percent of an original thickness associated with the underlayment material at a load of 3.1 psi and/or a compressive strength of more than 15 psi.

12 Claims, 8 Drawing Sheets

(56) References Cited

U.S. PATENT DOCUMENTS

| | | | | |
|---|---|---|---|---|
| 6,872,673 | B2 * | 3/2005 | MacAulay | 442/152 |
| RE38,745 | E * | 6/2005 | Foster | 428/77 |
| 7,081,300 | B2 * | 7/2006 | Laurence et al. | 428/423.7 |
| 7,114,298 | B2 * | 10/2006 | Kotler | 52/177 |
| 7,279,212 | B2 * | 10/2007 | Foxon | 428/95 |
| 7,441,384 | B2 | 10/2008 | Miller et al. | |
| 7,550,192 | B2 * | 6/2009 | Dempsey et al. | 428/192 |
| 7,735,279 | B2 | 6/2010 | Paradis et al. | |
| 7,866,104 | B2 * | 1/2011 | Babinsky et al. | 52/403.1 |
| 7,886,488 | B2 * | 2/2011 | Payne et al. | 52/144 |
| 8,056,292 | B2 * | 11/2011 | Swanson et al. | 52/403.1 |
| 2002/0025751 | A1 * | 2/2002 | Chen et al. | 442/324 |
| 2002/0081410 | A1 * | 6/2002 | Buckwalter et al. | 428/40.1 |
| 2002/0148185 | A1 | 10/2002 | Garduno | |
| 2002/0160680 | A1 * | 10/2002 | Laurence et al. | 442/394 |
| 2003/0219582 | A1 * | 11/2003 | Ramesh et al. | 428/304.4 |
| 2004/0086678 | A1 * | 5/2004 | Chen et al. | 428/44 |
| 2004/0129365 | A1 * | 7/2004 | Buckwalter et al. | 156/71 |
| 2004/0197544 | A1 * | 10/2004 | Ramesh et al. | 428/304.4 |
| 2005/0158517 | A1 * | 7/2005 | Rives et al. | 428/158 |
| 2006/0130416 | A1 * | 6/2006 | Mohr et al. | 52/403.1 |
| 2006/0156663 | A1 * | 7/2006 | Mao | 52/403.1 |
| 2006/0157195 | A1 * | 7/2006 | Laurence et al. | 156/307.1 |
| 2006/0179752 | A1 * | 8/2006 | Swanson et al. | 52/403.1 |
| 2007/0039268 | A1 * | 2/2007 | Ambrose et al. | 52/403.1 |
| 2007/0062139 | A1 * | 3/2007 | Jones et al. | 52/403.1 |
| 2007/0289238 | A1 * | 12/2007 | Payne et al. | 52/408 |
| 2008/0010930 | A1 * | 1/2008 | Mao | 52/403.1 |
| 2008/0124530 | A1 * | 5/2008 | Paradis et al. | 428/213 |
| 2010/0077684 | A1 * | 4/2010 | Socha | 52/403.1 |
| 2010/0251641 | A1 * | 10/2010 | Gallagher et al. | 52/177 |
| 2010/0272943 | A1 * | 10/2010 | Ddamulira et al. | 428/41.8 |
| 2011/0023763 | A1 | 2/2011 | Morgan et al. | |
| 2012/0135220 | A1 * | 5/2012 | Keane | 428/304.4 |

OTHER PUBLICATIONS

Sekisui, Voltek-Ideas Formed in Foam, http://www.voltek.com/body_products.html, accessed Jul. 27, 2006, 2 pages.

EC21-Youngbo Chemical Co., Ltd.-PE & PP Foam, EC 21 Global B2B Marketplace, http://youngbo.en.ec21.com/1/PE_PP_Foam.html, accessed Jul. 27, 2006, 2 pages.

U.S. Appl. No. 13/246,235, entitled "Low Reflected-Sound-Pressure-Level, Low Moisture-Vapor-Transmission-Rate Flooring System", filed Sep. 27, 2011, 14 pages.

ACH Foam Technologies, "Custom Molded EPE Physical Properties Data Sheet", http://www.achfoam.com/custom-molded-epe-physical-properties.aspx, ACH Foam Technologies, LLC; Retrieved Jul. 11, 2012 by Internet Archive Wayback Machine Beta, 2007,1 page.

AMI Acoustic Products Division, "Step Above™ Plus Flooring Underlayment Product Data Sheet", http://web.archive.org/web/20070114093646/http://www.soundprooffoam.com/step-above-plus.html; AMI Acoustic Products Division, American Micro Industries Inc., Chambersburg, PA, Feb. 17, 2006, 2 pages.

International Patent Application No. PCT/US12/038217: Written Opinion of the International Searching Authority dated Aug. 3, 2012, 20 pages.

Resilient Floor Covering Institute, "Resilient/Vinyl Glossary to RFCI", http://web.archive.org/web/20101129042226/http://rfci.com/index.php?option+com_contents, Retrieved Jul. 15, 2012 by Internet Archive Wayback Machine Beta 2010-2011, 5 pages.

* cited by examiner

LUXURY VINYL TILE FLOORING SYSTEM

CROSS-REFERENCE TO RELATED APPLICATIONS

This application claims the benefit of provisional application No. 61/519,112, filed May 16, 2011, the entirety of which is incorporated by reference herein.

BACKGROUND

A flooring system may include a layer of flooring, such as vinyl tile flooring for example, an underlayment material, and/or a subfloor. Underlayment materials may be used in the flooring system to provide a thin layer of cushion or protection in the flooring system between layers. Certain types of underlayment materials used in a flooring system may result in problems that may be caused due to the application of certain pressures during use.

For example, vinyl tile flooring systems may be susceptible to bending at the joints where adjacent pieces of flooring meet when an excessive load is applied and certain underlayment materials are used. Additionally, or alternatively, the underlayment materials themselves may be susceptible to damage under certain conditions, such as when an excessive load is applied near the joints where the adjacent pieces of flooring meet for example.

SUMMARY

A flooring system is described herein having a top floor layer, a subfloor, and/or an underlayment material disposed between the sub-floor and the top floor layer. The top floor layer may include a plurality of luxury vinyl tiles. Respective tile joints may be formed between adjacent luxury vinyl tiles. The underlayment material may comprise a cross-linked, polyolefin foam. The composition of the underlayment material may be such that the tile joints between the adjacent luxury vinyl tiles bend by less than about 45 degrees over a twelve hour period when 3.1 pounds per square inch (psi) of pressure is applied.

According to another example, the underlayment material may have a compressive creep of less than fifty percent of an original thickness associated with the underlayment material at a load of 3.1 psi.

According to another example, the underlayment material may have a compressive strength of more than 15 psi.

DETAILED DESCRIPTION

Embodiments are described herein for flooring systems, such as vinyl tile flooring systems for example, that may be constructed to prevent damage to the flooring system that may be caused by the application of certain loads during use. For example, a flooring system may comprise a luxury vinyl tile (LVT) and a foam underlayment material. The foam underlayment material may be installed under the LVT and may be configured such that the tile joints in the LVT do not bend more than a desired amount under certain pressures. Additionally, or alternatively, the foam underlayment material may be configured such that the foam underlayment itself is not damaged and/or maintains certain characteristics under application of certain pressures to the flooring system.

Figure 1A:
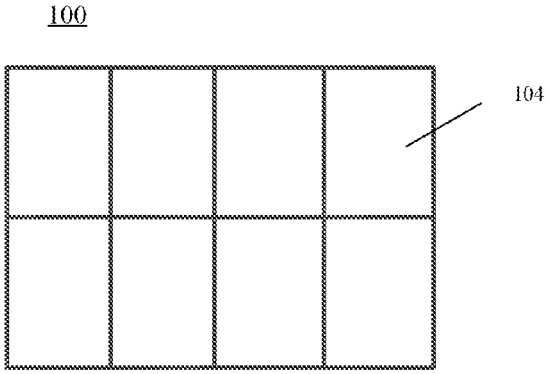
FIGS. 1A and 1B show example embodiments of luxury vinyl tile (LVT) flooring.
Figure 1B:
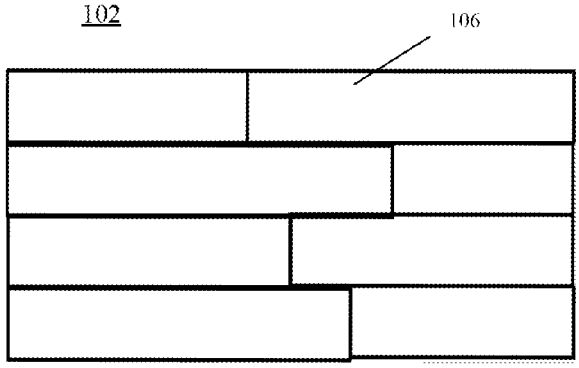

LVT is a type of flooring that may be used in the flooring systems described herein. L VT may be used in residential and/or commercial flooring systems. According to one embodiment, LVT may be as strong as tile, as stain-proof and/or water resistant as vinyl, and have the texture and/or detailed patterns found in laminate floors. L VT may come in various forms. FIG. 1A shows an example embodiment of LVT flooring 100 comprising a number of tiles, such as LVT flooring tile 104 for example. LVT flooring tile 104 may simulate ceramic tile or any other form of tile flooring for example. FIG. 1B shows an example embodiment of LVT flooring 102 comprising a number of planks, such as LVT flooring plank 106 for example. LVT flooring plank 106 may simulate hardwood or any other form of flooring that may be laid in the form of planks for example.

Figure 2A:
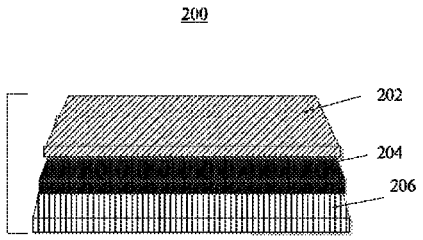
FIGS. 2A and 2B show example embodiments of layers that may be included in LVT flooring.
Figure 2B:
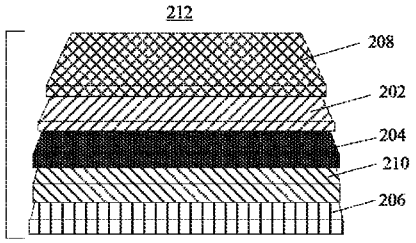

FIGS. 2A and 2B show example embodiments of LVT flooring materials 200 and 212 respectively. LVT flooring materials 200 and/or 212 may comprise an LVT flooring layer (e.g., top flooring layer) in a flooring system comprising multiple layers. As shown in FIGS. 2A and 2B, LVT flooring materials 200 and 212 may include a type of flexible vinyl floor tile and/or plank that may have a wear layer/finish 202, a décor layer 204, and a backing layer 206. The décor layer 204 may include a printed design or pattern, such as that of a piece of tile or wood for example, and/or may be comprised of a decorative film material. The décor layer 204 may be protected by the durable wear layer/finish 202. For example, the wear layer 202 may be made of urethane or any other protective layer that enables the décor layer 204 to be visible and protected. The backing layer 206 may provide a level of protection between the décor layer 204 and the materials installed below the LVT flooring materials 200 and/or 212, such as an underlayment or subfloor material for example.

As shown in FIG. 2B, ultraviolet (UV) hardened coating 208 may provide added wear protection to wear layer 202. Wear layer 202 may include ultraviolet (UV) hardened coating 208 or the two may be separate layers altogether. As further illustrated in FIG. 2B, the décor layer 204 and the backing layer may be separated by a balance layer 210.

Figure 3A:
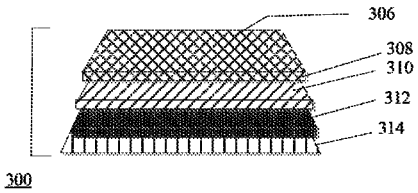
FIGS. 3A-3D show additional example embodiments of layers that may be included in LVT flooring.
Figure 3C:
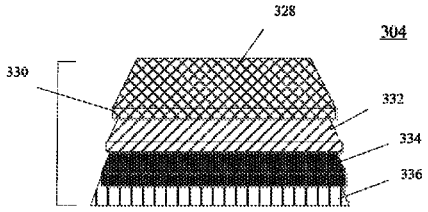
Figure 3B:
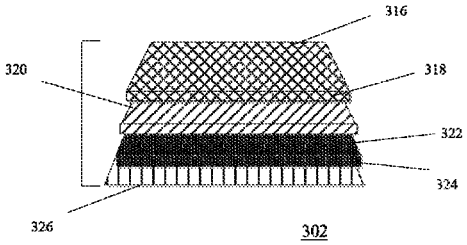
Figure 3D:
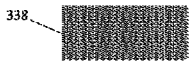

FIGS. 3A-3D show additional example embodiments of LVT flooring. As illustrated in FIGS. 3A-3C, LVT flooring 300, 302, and 304 may be comprised of a surface layer protection 306,316,328, a backing layer 314,326,336, a wear layer 308, 318, 330, and/or a decorative layer 310, 320, 332, respectively. LVT flooring 300 is an example embodiment of LVT flooring that includes a surface layer 306 and/or wear layer 308 comprising a polyurethane (PUR) finish, a backing layer 314 comprising polyvinyl chloride (PVC), and a decorative layer 310 comprising a printed effect. LVT flooring 300 also comprises a high density base layer 312 that separates the printed effect layer 310 and the PVC backing layer 314. LVT flooring 302 illustrates an example embodiment of LVT flooring that includes a surface layer 316 comprising an ultraviolet (UV) cured material, a backing layer 326 comprising PVC, a transparent wear layer 318, and a decorative layer 320 comprising a PVC decorative film. LVT flooring 302 also comprises a middle PVC backing 322 and a fiber glass layer 324 that separate the PVC decoration film 320 and the bottom PVC backing layer 326. LVT flooring 304 illustrates an example embodiment of LVT flooring that includes a surface layer 328 comprising a PUR surface protection (e.g., K-guard plus), a backing layer 336. The backing layer may comprise a heavy duty unique plasticized friction backing 338 (shown in FIG. 3D) having a number of ridges on the bottom to hold the LVT flooring 304 in place. LVT flooring 304 includes a wear layer 330 comprising a heavy duty clear PVC, and a decorative layer 332 comprising a photographic layer of natural timber. LVT flooring 304 also comprises a thick glass fiber dimensionally stable center layer 334 that separates the decorative layer 332 and the backing layer 336.

While FIGS. 3A-3D illustrate examples of materials and various layers that may comprise L VT flooring, these examples are not meant to be limiting. Thus, L VT flooring may comprise other materials and/or layers.

The LVT flooring materials may be incorporated as a layer in a flooring system, as further described herein. For example, a flooring system may comprise a top floor layer, a sub-floor layer, and/or an underlayment material disposed between the sub-floor and the top floor layer. According to an example embodiment, the top floor layer may comprise a form of LVT flooring, while the underlayment material may comprise a foam sheet. The foam sheet may provide for a level of cushion and/or protection for the flooring system. For example, the underlayment foam sheet may comprise a material which may prevent damage to the LVT flooring and/or the underlayment itself due to a load that may be applied to the flooring system during use. The underlayment may provide a low reflected sound pressure and/or a moisture vapor barrier for the flooring system.

Figure 4:
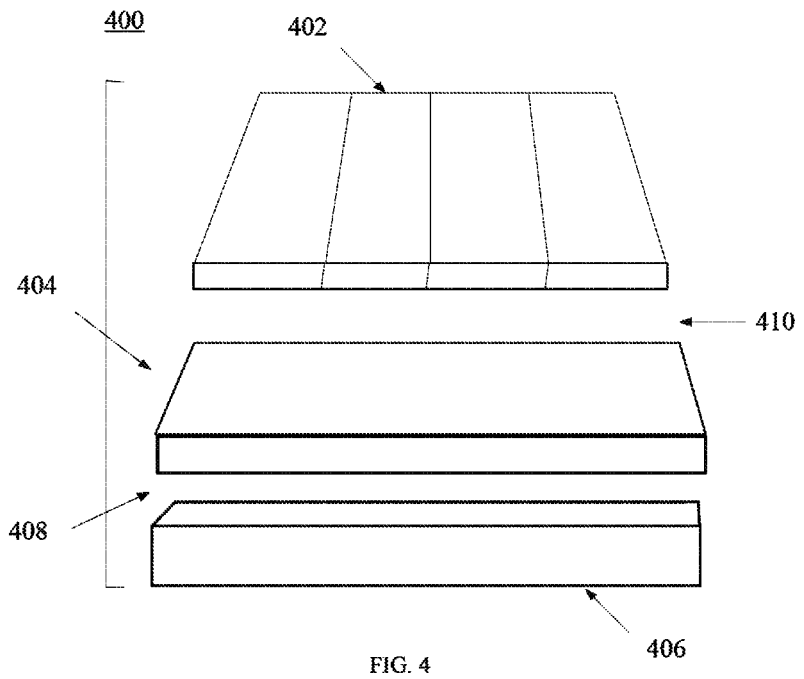
FIG. 4 shows an example embodiment of the layers that may comprise a flooring system as described herein.

FIG. 4 depicts an example of a flooring system 400. As shown in FIG. 4, the example flooring system 400 may include a top floor layer 402, an underlayment material 404, and a subfloor 406. According to an example embodiment, the top floor layer 402 may comprise LVT flooring and/or the underlayment material 404 may comprise a foam underlayment material. An example of an underlayment material 404 comprising one or more of the characteristics described herein may include a foam sheet about 3-4 feet wide, 1 mm thick, and/or having a density of 6 lb/ft$^3$. The subfloor 406 may comprise a wood or concrete subfloor. According to another example, the sub-floor 406 may be a previously-installed flooring system, for example, that is to be covered over, or any support structure, such as a system of floor joists, for example, on which the top layer 402 and/or underlayment material 404 are installed to form a flooring system 400. As shown in FIG. 4, the top floor layer 402 and the underlayment material 404 may be separated by space 410; and the underlayment material 404 and the sub-floor 406 may be separated by space 408. At spaces 408 and/or 410 an adhesive may be applied to affix the layers on either side of the space to one another. The foam underlayment may be affixed LVT flooring and/or a subfloor (e.g., using an adhesive).

The underlayment material 404, such as foam underlayment material for example, may comprise a material that enables the flooring system 400 to handle a certain load without damage to any layer of the flooring system (e.g., LVT flooring and/or foam underlayment). For example, the foam underlayment material 404 may have a compressive strength of greater than or equal to about 15 pounds per square inch (psi). According to an example embodiment, the compressive strength may be between about 15 psi and about 47 psi.

Figure 5:
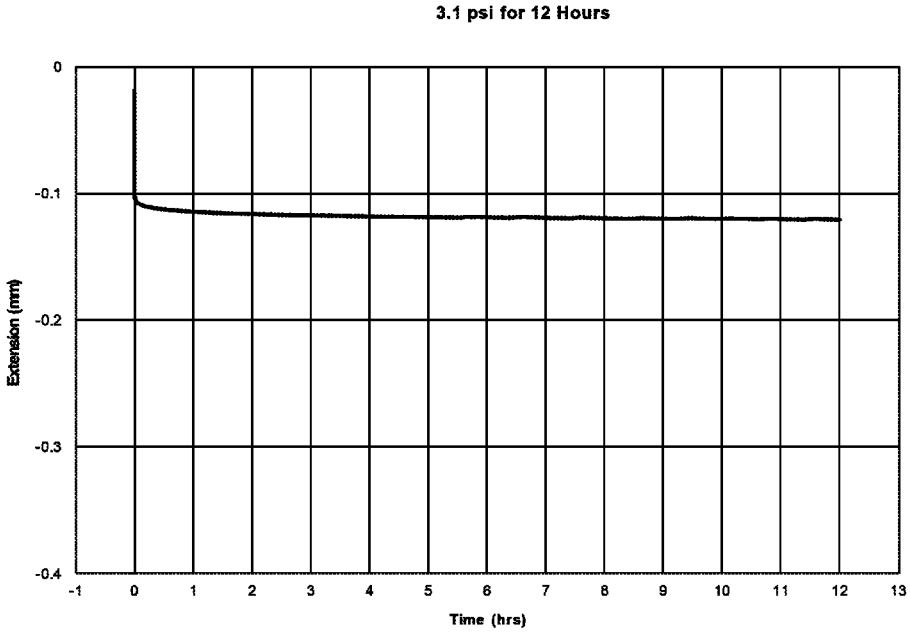
FIG. 5 shows an example of a compressive creep for an underlayment material.

The foam underlayment material 404 may have a compressive creep that enables the flooring system 400 to handle a certain load over a period of time. The compressive creep may be a change in the thickness of the underlayment foam caused by the application of a load to the flooring system 400 (e.g., after the initial application of the load). The foam underlayment material 404 may have a compressive creep of less than or equal to about 50% of its original thickness over a period of about twelve hours with a load of about 3.1 psi. For example, the foam underlayment material 404 may compress less than 0.1 millimeter over a twelve hour period, as shown in FIG. 5.

Referring back to FIG. 4, the top floor layer 402 may comprise pieces of LVT flooring. The pieces of LVT flooring that make up the top floor layer 402 may be installed such that an excessive load may cause an unacceptable amount of bending, or even damage, to the LVT flooring. The foam underlayment material 404 may enable the flooring system 400 to handle a certain load without an unacceptable amount of bending or damage to pieces of LVT flooring in the top floor layer 402. For example, the foam underlayment material 404 may comprise a material that enables the LVT flooring tile joints, at which the pieces of LVT flooring in the top floor layer 402 meet, to bend by less than or equal to about a 45 degree angle when experiencing a load on the flooring system 400 of about 3.1 psi over a 12 hour period. According to one example, the load may be applied to LVT flooring tile joints of the flooring system 400.

Figure 6A:
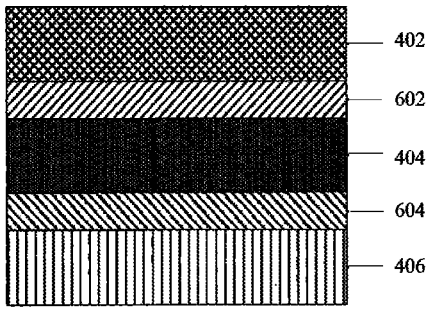
FIGS. 6A and 6B show example embodiments of additional layers that may comprise a flooring system as described herein.
Figure 6B:
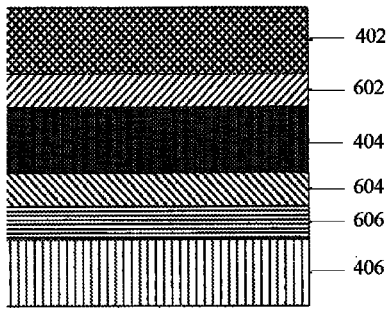

FIGS. 6A and 6B depict cross-sectional views of the flooring system illustrated in FIG. 4. As shown in FIG. 6A, the layers 402, 404, and 406 may be affixed to one another at spaces 408 and 410 by any means. For example, the layers 402, 404, and 406 may be nailed or tacked together. An adhesive 602 may be applied at space 410 between the top floor layer 402 and the underlayment material 404. Similarly, an adhesive 604 may be applied at space 408 between the underlayment material 404 and the sub-floor 406. The adhesives 602, 604 may be optional and one or both adhesives may be used. The adhesives 602, 604 may be the same or different. Each adhesive 602, 604 may be a high-performance underlayment adhesive, glue, or any other adhesive for example.

As shown in FIG. 6B, the flooring system may include an optional vapor barrier layer 606. The underlayment material 404 may have moisture vapor transmission properties that may be suitable for certain applications. In some applications, however, additional moisture vapor protection may be desirable. If desired, a vapor barrier layer 606 may be disposed between the top floor layer 402 and the sub-floor 406. The vapor barrier layer 606 may be a film, such as a polypropylene film for example, which may be disposed between the underlayment material 404 and the sub-floor 406. The vapor barrier layer 606 may be adhered to the underlayment material 404 and/or to the sub-floor 406. It should be understood that, in one example, the vapor barrier layer 606 may be adhered to the underlayment material, using adhesive 604 for example, before it is rolled. Thus, the underlayment material 404 may be delivered to the point of installation with the optional vapor barrier 606 already adhered thereto and simplifying installation of the underlayment material 404 and vapor barrier 606.

The foam underlayment material 404 may be comprised of various materials which may result in different compressive strength, gel fraction, density, and/or resin composition. For example, the underlayment material 404 may include a cross-linked polypropylene copolymer (EPC) and/or a linear low density/polyethylene (LLDPE) blend foam with an EPC content of about 20% to 90% by weight. Other olefin materials that may be used may include, for example, homopolymers and copolymers of polyethylene, including high-density polyethylene (HDPE), low-density polyethylene (LDPE), very-low-density polyethylene (VLDPE), ultra-low-density polyethylene (ULDPE), and/or polymers or copolymers of polypropylenes, including cross-linked ethylene propylene copolymer for example. Example embodiments for manufacturing a polyolefin foam underlayment material are disclosed in U.S. patent application Ser. No. 11/261,977, which is incorporated by reference herein in its entirety.

The underlayment material 404 may have a 25% compressive strength as measured by Japanese Industrial Standard (JIS) K 6767 and/or ASTM 3575. Materials having compressive strength below about 0.85 kg/cm$^2$ may be too soft. According to an example embodiment, the underlayment material 404 may have a 25% compressive strength of at least about 1.0 kg/cm$^2$.

Compressive strength may be a property of the foam structure that may be obtained by the selection of resin, foam density, and/or the manufacturing processes used to convert resin into foam. Higher polypropylene content may produce higher compressive strength and, accordingly, lower average reflected SPL. The polypropylene content may be of about: (1) 25 to 30%, (2) 50% to 60%, or (3) 70% to 90%. Density may also be a factor. For example, to increase compressive strength from approximately 3 kg/cm$^2$ to approximately 6 kg/cm$^2$, the foam density might be increased from about 100 kg/m$^3$ to about 121 kg/m$^3$.

The gel fraction (a.k.a., cross-link percentage or cross-link level) of the underlayment material 404 may range from about 15% to about 80%. Higher cross-link levels may be possible; however, if cross-linking is too high, the foam may be difficult to roll onto a core, and may be difficult to lay flat which may make installation difficult. Example embodiments of a preferred range of cross-linking may be 40% to 60% or 50% to 60%. The type of resins selected, the amount of chemical cross-linking agent used, and/or the amount of exposure to a radiation source, such as an electron beam irradiation device for example, may determine the degree of cross-linking. Higher cross-link percentage may provide a higher compressive strength.

The density of the underlayment material 404 may be about 20 to 200 kg/m$^3$. Foam densities of less than about 25 kg/m$^3$ may be possible; however, the underlayment material 404 may be too soft and/or may compress under loading. Higher density may increase the compressive strength of the foam underlayment 404. Increasing foam density, however, may add to product cost due to increased raw material consumption to manufacture. Density may be controlled by a number of factors, such as the types of resins used, the degree of cross-linking, process conditions, and/or the type and amount of foaming agent used.

The thickness of the underlayment material 404 may range from about 0.5 mm to about 6.0 mm. According to an example embodiment, the thickness of the underlayment material may be around 1 mm. Thinner foams than about 0.5 mm may lack the resiliency under the loading of the flooring system. Foams thicker than about 6.0 mm may be suitable for underlayment membranes, however, relatively thick layers of around 6.0 mm or more may interfere with wall molding or door clearances. Thickness may be determined by the resin selection, type and amount of chemical foaming agent used, extruded sheet thickness, tension during the foaming operation, and/or the amount of heat applied during the conversion of sheet into foam.

The underlayment material 404 may provide for reduced moisture vapor transmission rate (MVTR). For example, the underlayment material 404 may have a moisture vapor transmission of less than or equal to about 3 lb/1000 sqft., over a 24 hour period of time. The underlayment material 404 may provide an improved reflected sound pressure density, without the need for the additional barrier layers for example, in a lightweight, easy-to-handle material. For example, the underlayment material 404 may be of an impact isolation class (IIC) and/or a sound transmission class (STC) of greater than or equal to about 50. The underlayment material 404 may enable the flooring system 400 to produce an average reflected sound pressure level of less than about 15 dB over a range of about 300 Hz to about 1000 Hz.

Table 1 illustrates example specifications for LVT flooring systems, or portions thereof, described herein.

TABLE 1

| Characteristic | | Method | Units | Specification |
|---|---|---|---|---|
| Width | | ASTM 3575 | in | Customer Request |
| Thickness | | ASTM 3575 | in | .03~.045 |
| Apparent Density | | | pcf | 5.5~7.0 |
| Gel Fraction | | | % | 50~60 |
| Compressive Strength @ 25% | | ASTM 3575 | psi | ≥47.0 |
| Tensile | MD | ASTM 3575 | psi | ≥320.0 |
| Strength | TD | | | ≥270.0 |
| Elongation | MD | ASTM 3575 | % | ≥260 |
| | TD | | | ≥230 |
| Tear | MD | ASTM 3575 | psi | ≥150.0 |
| Strength | TD | | | ≥180.0 |
| Thermal | MD | ASTM 3575 | % | −5~0 |
| Stability | TD | | | −4~1 |
| Thermoforming Ratio | | | — | ≥0.48 |

A flooring system using LVT materials may be installed a number of ways. A vinyl tile flooring system may be applied using different installation methods. For example, pieces of LVT flooring (e.g., the and/or planks) may be installed using a loose lay or "floating" installation, a locking installation, and/or a glue down installation, such as a double glue down installation for example. In some forms of installation an adhesive and/or a proper sized trowel may be used, while in others the flooring may be floated. For example, in a loose lay installation, pieces of LVT flooring may be installed without using an adhesive to affix the pieces of flooring to one another and/or to other layers of flooring. A modified loose lay installation may be performed by using an adhesive in strategic predefined spots, such as under appliances or other objects that may put pressure or stress on the flooring. The locking installation system may be implemented by installing LVT flooring with a unique tongue-and-groove profile that may allow for easy and quick installation of LVT flooring by locking the edges of the pieces into place. When the locking installation is performed, an adhesive may or may not be used to affix the pieces of flooring to one another and/or to other layers of flooring. In a glue-down installation, an adhesive may be used to affix the underlayment to the substrate and/or the LVT flooring layer.

Figure 7A:
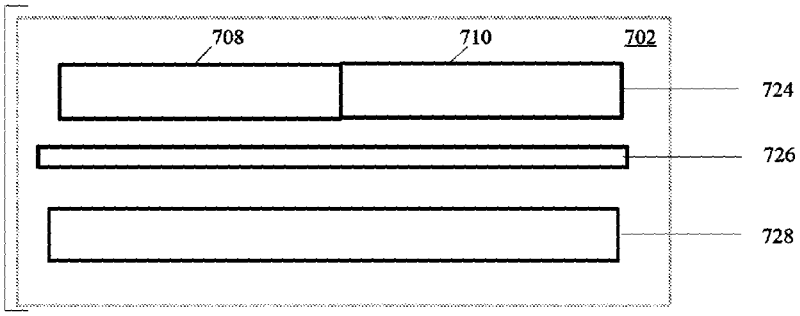
FIGS. 7A-7C show example embodiments of LVT flooring installation systems.
Figure 7B:
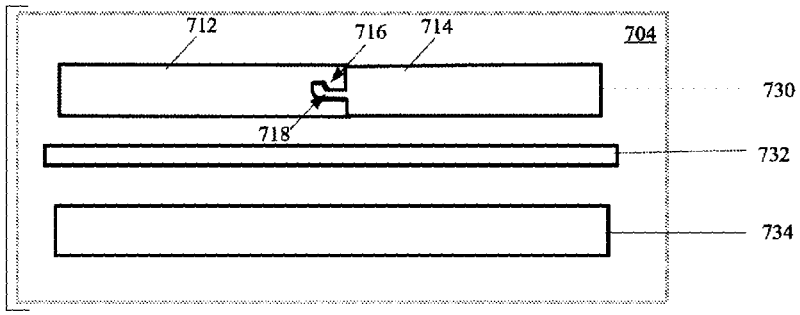
Figure 7C:
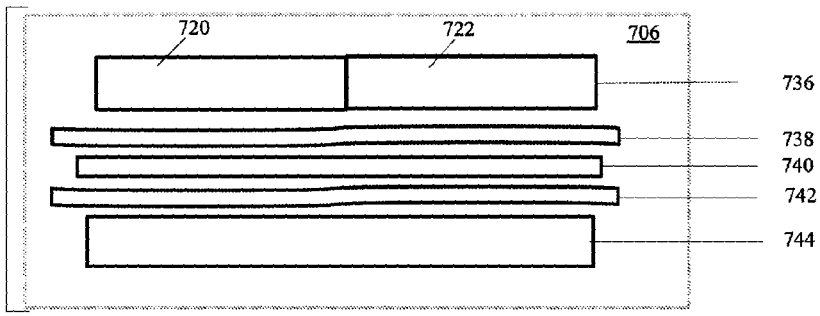
Figure 8A:
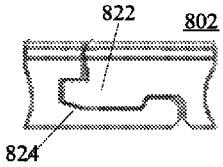
FIGS. 8A-8J show additional examples for installing LVT flooring using a locking installation.
Figure 8B:
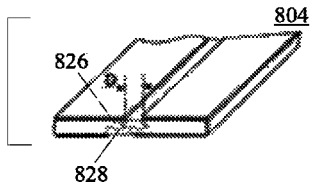
Figure 8C:
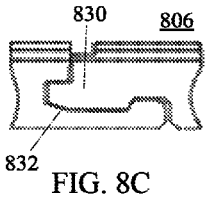
Figure 8D:
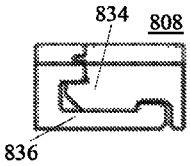
Figure 8E:
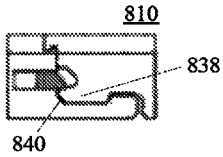
Figure 8F:
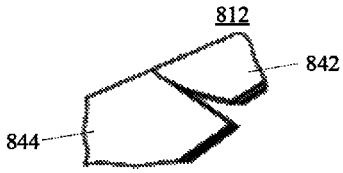
Figure 8G:
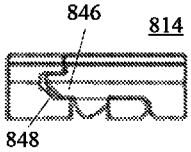
Figure 8H:
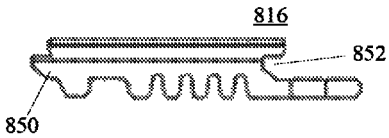
Figure 8I:
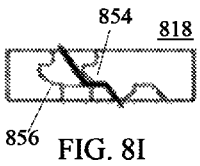
Figure 8J:
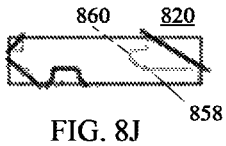

FIGS. 7A-7C illustrate various forms of LVT flooring installation systems. For example, FIG. 7A shows an example embodiment of a free floating or loose lay LVT installation. The flooring system 702 may be comprised of LVT flooring layer 724, LVT flooring underlayment 726, and/or subfloor 728. The LVT flooring layer 724 may be comprised of one or more pieces of LVT flooring, such as LVT flooring pieces 708 and 710 for example. LVT flooring pieces 708 and/or 710 may be an LVT plank or an LVT tile. The LVT flooring pieces 708 and 710 may be free floating (e.g., unconnected to one another) or may be affixed to one another via an adhesive. The LVT flooring layer 724 may be manufactured and/or installed on top of LVT flooring underlayment layer 726. LVT flooring underlayment layer 726 may comprise a foam underlayment material that may prevent damage to the LVT flooring layer 724 and/or the LVT flooring underlayment layer 726 when a load applied to the LVT flooring 724. The LVT flooring underlayment layer 726 and the LVT flooring layer 724 may be installed on top of subfloor 728. As shown in FIG. 7A, the LVT flooring 724, LVT flooring underlayment 726, and/or the subfloor 728 may be installed as a flooring system 702 in a free floating manner without being affixed to one another.

FIG. 7B shows an example embodiment for installing LVT flooring using a locking installation. As illustrated in FIG. 7B, a flooring system 704 may comprise an LVT flooring layer 730, an LVT flooring underlayment layer 732, and/or a subfloor 734. The LVT flooring layer 730 may comprise one or more pieces of LVT flooring, such as LVT flooring pieces 712 and 714 for example. LVT flooring pieces 712 and/or 714 may be an LVT plank or an LVT tile. The LVT flooring pieces 712 and 714 may be interlocked (e.g., at manufacture or installation) to one another. For example, LVT flooring piece 712 may comprise a groove 716 configured to receive the interlocking tongue 718 of LVT flooring piece 714. The LVT flooring pieces 712 and 714 may be interlocked such that the pieces are connected to one another without sliding. The LVT flooring pieces 712 and 714 may be interlocked with or without the use of adhesive or other means for affixing the pieces together.

The LVT flooring layer 730 may be manufactured and/or installed on top of LVT flooring underlayment layer 732. LVT flooring underlayment layer 732 may comprise a foam underlayment material that may prevent damage to the LVT flooring underlayment layer 732 and/or LVT flooring 730 when a load is applied to the LVT flooring 730. The L VT flooring 730, L VT flooring underlayment 732, and/or the subfloor 734 may be installed as a flooring system 704, with or without being affixed to one another for example.

FIG. 7C shows an example embodiment of a glue down LVT installation. The glue down LVT installation shown in FIG. 7C may be a double glue down installation as two adhesives, adhesive 738 and adhesive 742 may be used. The flooring system 706 may be comprised of LVT flooring layer 736, an adhesive 738, LVT flooring underlayment 740, an adhesive 742 (e.g., which may be the same or different from the adhesive 738), and/or subfloor 744. The LVT flooring layer 736 may be comprised of one or more pieces of LVT flooring, such as LVT flooring pieces 720 and 722 for example. LVT flooring pieces 720 and/or 722 may be an LVT plank or an LVT tile. The LVT flooring pieces 720 and 722 may be free floating (e.g., unconnected to one another) or may be affixed to one another via an adhesive or interlocking (not shown). The LVT flooring layer 736 may be installed and/or manufactured on top of LVT flooring underlayment layer 740. LVT flooring underlayment layer 740 may comprise a foam underlayment that may prevent damage to the LVT flooring underlayment layer 740 and/or the LVT flooring 736 when a load is applied to the LVT flooring 736. The LVT flooring layer 736 and the LVT flooring underlayment layer 740 may be affixed to each other using adhesive 738, such as glue or any other adhesive capable of affixing the LVT flooring 736 to the underlayment 740 for example.

The LVT flooring underlayment layer 740 and the LVT flooring layer 736 may be installed on top of subfloor 744. The LVT flooring underlayment layer 740 may be affixed to the subfloor 744 using an adhesive 742 such as glue or any other adhesive capable of affixing the LVT flooring underlayment 740 to the subfloor 744 for example. The adhesive 742 may be the same as, or different from, the adhesive 738. As shown in FIG. 7C, the LVT flooring 736, LVT flooring underlayment 740, and/or the subfloor 744 may be installed as a flooring system 706, with each layer being affixed to one or more other layers. While FIG. 7C shows the use of adhesive 738 and adhesive 742, it should be understood that one or both of these adhesives may be used.

FIGS. 8A-8J show additional examples for installing LVT flooring using a locking installation. As shown in FIGS. 8A-8J, LVT flooring may be installed using various tongue-and-groove profiles. For example, each piece of LVT flooring 802, 804, 806, 808, 810, 812, 814, 816, 818, 820 may comprise one or more tongues 822, 826, 830, 834, 838, 842, 846, 850, 854, 858 and/or one or more grooves 824, 828, 832, 836, 840, 844, 848, 852, 856, 860 to enable interlocking with other pieces of LVT flooring.

Although features and elements are described above in particular combinations, each feature or element may be used alone or in any combination with the other features and elements. For example, various layers of flooring are described herein, which may be used in any combination in a flooring system.

What is claimed:

1. A flooring system, comprising:

a top floor layer comprising a plurality of luxury vinyl tiles, wherein the top floor layer comprises a tile joint between adjacent tiles of the plurality of luxury vinyl tiles;

a sub-floor; and an underlayment material comprising a cross-linked, polyolefin foam disposed between the sub-floor and the top floor layer, wherein the underlayment material has a density in a range of about 20 kilograms per cubic meter ($kg/m^3$) to about 200 $kg/m^3$, a thickness in a range of about 0.5 millimeter (mm) to about 6 mm, and a compressive strength of more than 15 pounds per square inch (psi), wherein the underlayment material is configured to prevent a portion of at least one of the plurality of luxury vinyl tiles at the tile joint from bending, relative to another portion of the top floor layer, by more than about 45 degrees over a twelve hour period when at least 3.1 psi of pressure is applied to at least one of the tile joint or the portion of the at least one of the plurality of luxury vinyl tiles at the tile joint.

2. The flooring system of claim 1, wherein the thickness of the underlayment material comprises a first thickness, and wherein the underlayment material has a compressive creep that results in the underlayment material comprising a second thickness of less than fifty percent of the first thickness when the at least 3.1 psi of pressure is applied for a period of time.

3. The flooring system of claim 1, wherein each of the plurality of luxury vinyl tiles comprises a respective surface layer protection, backing layer, wear layer, and decorative layer.

4. The flooring system of claim 1, wherein the plurality of luxury vinyl tiles are installed using a loose lay installation.

5. The flooring system of claim 1, wherein the plurality of luxury vinyl tiles are installed using a modified loose lay installation.

6. The flooring system of claim 1, wherein the plurality of luxury vinyl tiles are installed using a locking installation.

7. The flooring system of claim 1, wherein the plurality of luxury vinyl tiles are installed using a glue down installation.

8. The flooring system of claim 1, wherein the cross-linked, polyolefin foam has a moisture vapor transmission rate of less than about 3.0 lb/1000 $ft^2$/24 hr.

9. The flooring system of claim 1, wherein the cross-linked, polyolefin foam has at least one of an impact isolation class (IIC) or a sound transmission class (STC) of greater than about 50.

10. The flooring system of claim 1, wherein the underlayment material enables the flooring system to produce an average reflected sound pressure level of less than about 15 decibels (dB) over a range of about 300 hertz (Hz) to about 1000 Hz.

11. The flooring system of claim 1, wherein the density of the underlayment material is in a range of about 5.5 pounds per cubic foot (pcf) to about 7.0 pcf.

12. The flooring system of claim 1, wherein the density of the underlayment material is about 6 pounds per cubic foot (pcf).

* * * * *